US011229301B2

(12) United States Patent
Schwarz et al.

(10) Patent No.: US 11,229,301 B2
(45) Date of Patent: Jan. 25, 2022

(54) HINGE AND DISPENSING DEVICE

(71) Applicants: Lidl Stiftung & Co. KG, Neckarsulm (DE); WANZL METALL-WARENFABRIK GMBH, Leipheim (DE); VALENTINI GLASS & COMPONENTS SRL, Brescia (IT)

(72) Inventors: Martin Schwarz, Neckarsulm (DE); Oliver Menke, Neckarsulm (DE); Philipp Gress, Neckarsulm (DE); Markus Benz, Aislingen (DE); Hans Schlumberger, Asselfingen (DE); Walter Valentini, Brescia (IT)

(73) Assignee: Lidl Stiftung & Co. KG, Neckarsulm (DE)

( * ) Notice: Subject to any disclaimer, the term of this patent is extended or adjusted under 35 U.S.C. 154(b) by 0 days.

(21) Appl. No.: 16/764,878

(22) PCT Filed: Nov. 19, 2018

(86) PCT No.: PCT/EP2018/081755
§ 371 (c)(1),
(2) Date: Aug. 14, 2020

(87) PCT Pub. No.: WO2019/097052
PCT Pub. Date: May 23, 2019

(65) Prior Publication Data

US 2021/0145190 A1 May 20, 2021

(30) Foreign Application Priority Data

Nov. 17, 2017 (DE) ..... 102017127163.5

(51) Int. Cl.
*E05D 11/10* (2006.01)
*A47F 3/04* (2006.01)
(Continued)

(52) U.S. Cl.
CPC ..... *A47F 3/043* (2013.01); *A47F 3/125* (2013.01); *E05F 1/02* (2013.01); *E05F 3/20* (2013.01);
(Continued)

(58) Field of Classification Search
CPC ..... E05F 1/02; E05F 1/06; E05F 1/08; E05F 1/10; E05F 1/1041; E05F 1/1091;
(Continued)

(56) References Cited

U.S. PATENT DOCUMENTS 4,761,853 A * 8/1988 Hoffman ..... E05D 3/122 16/302
4,844,567 A * 7/1989 Chalabian ..... E05F 1/1058 312/139
(Continued)

FOREIGN PATENT DOCUMENTS

| | | |
|---|---|---|
| DE | 202017103403 | 8/2017 |
| EP | 1911983 | 4/2008 |
| JP | 07286472 | 10/1995 |

*Primary Examiner* — Chuck Y Mah
(74) *Attorney, Agent, or Firm* — Head, Johnson, Kachigian & Wilkinson, PC

(57) ABSTRACT

The invention relates to a hinge (10) for a dispensing device (12), wherein the hinge (10) is substantially bar-shaped and/or tubular for fastening to a door (14) of the dispensing device (12), the hinge (10) having at least a main body (20) and an insertion rail (22) for the door arranged on the main body (20), wherein the door (14) is inserted in the assembled state in the insertion rail (22) and is held in the insertion rail (22), wherein at least one damping device (24) and at least one panic hinge device (26) are provided in the main body (20).

22 Claims, 5 Drawing Sheets

(51) Int. Cl.

| | |
|---|---|
| ***A47F 3/12*** | (2006.01) |
| ***E05F 1/02*** | (2006.01) |
| ***E05F 3/20*** | (2006.01) |
| ***E05F 5/02*** | (2006.01) |

(52) U.S. Cl.
CPC ..... *E05F 5/02* (2013.01); *A47B 2220/0069* (2013.01); *E05Y 2900/202* (2013.01); *E05Y 2900/204* (2013.01)

(58) Field of Classification Search
CPC ..... E05F 1/12; E05F 1/1223; E05F 1/1246; E05F 1/1253; E05F 1/1261; E05F 1/1292; E05F 1/14; E05F 3/20; E05F 5/02; E05F 5/06; E05F 5/08; E05F 5/10; E05F 5/12; E05F 3/18; E05D 11/1021; E05D 3/12; E05D 3/14; E05D 3/16; E05D 15/40; E05D 15/401; E05D 15/405; E05D 15/406; E05D 15/42; E05D 15/58; E05D 15/565; E06B 3/5045; E05Y 2800/22; E05Y 2900/20; E05Y 2900/202; E05Y 2900/204; E05Y 2900/208; E05Y 2201/21; E05Y 2201/264; E05Y 2201/212; E05Y 2201/604; A47F 3/043; A47F 3/0434; A47F 3/125; A47B 2220/0069; A47B 2220/0072
See application file for complete search history.

(56) References Cited

U.S. PATENT DOCUMENTS

| | | | | | |
|---|---|---|---|---|---|
| 5,237,684 | A * | 8/1993 | Record | G06F 11/3466 | 714/E11.2 |
| 5,755,496 | A * | 5/1998 | Hahn | A47F 3/005 | 312/139 |
| D411,434 | S * | 6/1999 | Russell | E05F 1/1058 | D8/323 |
| 7,197,790 | B1 * | 4/2007 | Edmondson | E05D 3/16 | 16/286 |
| 8,256,064 | B2 * | 9/2012 | Blersch | E05D 3/18 | 16/286 |
| 8,966,713 | B1 * | 3/2015 | Russo | E05D 7/0009 | 16/285 |
| 9,187,944 | B2 * | 11/2015 | Gianetti | E05F 15/53 | |
| 9,206,636 | B2 * | 12/2015 | Nagi | E05F 3/20 | |
| 9,428,946 | B2 * | 8/2016 | Martinez Garcia | E05D 11/0054 | |
| 9,719,285 | B2 * | 8/2017 | Nagi | E05F 3/20 | |
| 10,370,884 | B2 * | 8/2019 | Stuke | E05F 1/1008 | |
| 10,428,575 | B2 * | 10/2019 | Hanratty | E05D 5/02 | |
| 2005/0246863 | A1 * | 11/2005 | Chesworth | E05F 1/063 | 16/221 |
| 2012/0084944 | A1 * | 4/2012 | Hirtsiefer | E05D 3/14 | 16/302 |
| 2017/0306680 | A1 * | 10/2017 | Zetti | E05F 5/10 | |
| 2018/0000259 | A1 * | 1/2018 | Cichuta | A47F 1/04 | |

* cited by examiner

HINGE AND DISPENSING DEVICE

CROSS-REFERENCE TO RELATED APPLICATIONS

The present application is a national phase application of International PCT Patent Application No. PCT/EP2018/081755 filed Nov. 19, 2018.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB

Not Applicable

STATEMENT REGARDING PRIOR DISCLOSURES BY THE INVENTOR OR A JOINT INVENTOR

Not Applicable

BACKGROUND OF THE INVENTION

(1) Field of the Invention

The present invention relates to a hinge for a dispensing device and a dispensing device for unpackaged goods, in particular baked goods with such a hinge.

(2) Description of Related Art Including Information Disclosed Under 37 CFR 1.97 and 1.98

Dispensing devices for unpackaged goods, in particular baked goods, are known from the prior art, for example from DE 20 2013 105 382 U1, DE 20 2016 103 424 U1, WO 2014/118202 A1, WO 2014/118203 A1, and DE 20 2013 100 425 U1.

Furthermore, pivotable connecting and closing devices, in particular hinges, are known from prior art, for example from DE 20 2009 004 271 U1, WO 2009118276 A1, DE 10 2005 039 287 B4, DE 19744514 A1, US 2007/052251 A1, and DE 10 2005 014 924 B4.

BRIEF SUMMARY OF THE INVENTION

It would be desirable to expand the pivoting capabilities of a door of dispensing devices to easily move in panic situations the door of the dispensing device protruding into the aisle of a supermarket, for example, and to pivot it further in a defined manner.

It is therefore the object of the present invention to develop a hinge for a dispensing device of the type mentioned above in an advantageous manner, in particular in that the hinge provides a nondestructive and reversible panic opening function of a door of a dispensing device.

This object is achieved by a hinge with the features of claim 1. Accordingly, it is provided that a hinge is provided for a dispensing device wherein the hinge is formed substantially bar-shaped and/or tubular for fastening to a door of the dispensing device, wherein the hinge has at least one main body and, arranged on the main body, an insertion rail for the door, wherein the door is inserted in the assembled state in the insertion rail and held in the insertion rail, wherein at least one damping device and at least one panic hinge device are provided in the main body, wherein the hinge comprises a first pivoting range having a first swiveling resistance and a second pivoting range having a second swiveling resistance, wherein the first swiveling resistance is lower than the second swiveling resistance, wherein the second swiveling resistance is determined by the panic hinge device, and that, in the second pivoting range, only a damped and/or inhibited swiveling is made possible by the second pivoting range, wherein the second pivoting range has at least a first angular range and at least one second angular range adjoining the first angular range, wherein, at the initiation of the panic function, the opening force is increased in a first angular range, and in the second angular range the hinge can be opened in a dampened manner with a lower opening force than in the first angular range.

The invention is based on the idea of providing a hinge for a dispensing device that can be substantially completely accommodated in a side strut of the dispensing device. This can reduce the risk of injury to users of the dispensing device. It is conceivable, in particular, to be able to fully retract the hinge in a strut of the dispensing device or even to form an entire strut of the dispensing device with the hinge. By providing a damping device and a panic hinge device in the main body of the hinge, it is possible to provide a damped opening or closing movement. The panic hinge device makes it possible to provide a second opening angle after a first opening angle of the door which can be opened in a braked, inhibited, or damped manner. Such a configuration makes it possible to provide a panic function. For dispensing devices for unpackaged goods, particularly baked goods, that are placed in retail outlets, the open door of the dispensing device may protrude significantly into the aisle. If a dangerous situation arises in the retail outlet, the aisles also serve as escape routes, and the opened door may be an obstacle. The panic hinge device makes it possible to push the door of the dispensing device open wider, i.e., the opening angle of the door can be increased, making it possible to make the aisle more available. The door of the dispensing device therefore does not have to be closed but can be opened wider by overcoming the predefined resistance. This feature is also called a panic function.

The two different swiveling resistances in the context of the panic function make it possible that initially the opening movement is made more difficult in the panic function, but preferably initially only with a moderate increase of the opening force to be applied in the first angular range. As soon as the first angular range is left within the context of the panic function, the door should be able to be opened quickly and with less resistance so that, in the second angular range, the opening force to be applied is reduced again compared to the first angular range.

Furthermore, the main body and the insertion rail may have substantially the identical length, in particular wherein the insertion rail extends substantially beyond the entire length of the main body. This facilitates a uniform introduction of force from the insertion rail into the main body and vice versa. This allows for a better fastening of the door in general. Overall, this more uniform distribution of force and momentum facilitates an improved load on the entire hinge construction, which is why, for example, the main body can have a much slimmer and smaller design.

The insertion rail and the door may have substantially the same length. As a result, a better fastening and a better catching of the door in the insertion rail is facilitated as well. It is conceivable, for example, that the insertion rail and the door are pushed into each other, for example. In this context, the insertion rail is formed as a U-profile, into which the door is inserted.

The door may, at least partially, consist of a transparent material. It is also possible that the door is a glass door or at least has a glass pane. This makes it possible to look inside the dispensing device.

Furthermore, the hinge may have a gas spring, by means of which the movements of the hinge can be supported and/or damped. It is conceivable, in particular, that the gas spring provides no resistance when the door is opened and, when the door is closed, it is slowed down because the gas in the gas spring must first be displaced during closing and this resistance must therefore be overcome. As a result, a braked door closing movement or even a soft-close function (e.g., in conjunction with another damping element) can be achieved. It is conceivable in this context, in particular, that the gas spring is arranged in the main body of the hinge. Furthermore, the hinge may have, either additionally or alternatively to the gas spring, a further elastic element by means of which the movements of the hinge can be supported and/or damped. Such an elastic element may be, for example, a mechanical damping element or a hydraulic damping element (for example an oil damper). A combination of the mechanical and the hydraulic damping element is conceivable in this context as well.

It is conceivable, in particular, that the panic hinge device comprises a gas spring.

The first swiveling range may include an opening angle of the door from the closed state of the door to an opening angle of the opened door in a range of from approx. 80° to approx. 110°, in particular in a range from approx. 85° to approx. 100°, preferably from approx. 85° to approx. 90°.

This range is sufficient for the normal operation of the dispensing device and makes it possible for the customer to operate the dispensing device in a convenient manner. An opening beyond 90° is usually not required for the first pivoting range.

The second pivoting range is necessary in the context of the panic function and is considered sufficient in this area to further push the door in a panic situation when the panic function is needed so that a supermarket aisle is sufficiently cleared to allow for an escape through the aisle.

Furthermore, the insertion rail arranged on the main body may be pivotably arranged on the main body. This results in further movement capabilities.

It is also possible that the first angular range extends beyond an opening angle of approx. 90° to approx. 105° and/or that the second angular range begins at approx. 105°, in particular wherein the second angular range extends beyond an opening angle from approx. 105° to approx. 180°.

Furthermore, the first pivoting range with its first pivoting resistance may require an opening force from approx. 5 N to 8 N (approximately 5-8 Newtons). The opening force may, in particular, be approx. 5 N. The advantage is that, due to the comparatively low opening force, an easier opening in the first pivoting range is made possible.

In particular, it is further conceivable that the second pivoting range in the first angular range requires an opening force from approx. 9 N to approx. 12 N (approx. 9-12 Newtons). In particular, the opening force may be approx. 9-10 N. The effect is that in this angular range (e.g., from approx. 85°-90° to approx. 105°-110°, an increased opening force is required to push the door open (so-called panic function=which makes it possible to open the already opened door even more under increased effort).

It is also possible that the second pivoting range in the second angular range requires an opening force of approx. 8 N (approx. 8 Newtons), This angular range may begin, for example, between approx. 105° and 110° and end at approx. >160°.

In principle, it is conceivable that the closing forces are chosen in a comparable manner.

In the closing direction, a closing force of approx. 8 N may be required in a range from approx. 160° to >110°-105°. Next, it is possible to provide in the closing direction that a closing force of approx. 9-10 N is required in an angle between approx. 110° and approx. 105° to approx. 90° and approx. 85°.

Starting with an angle from approx. 90° to 85°, the effect of gravity in the closing direction is sufficient as the closing force. It is conceivable to configure the hinge for this area in such a way that it is designed to be self-closing but damped.

Below 20°, for example, damping is not absolutely necessary in the closing direction. Preferably, it can be omitted in this area.

It is conceivable that the closing time is approx. 10 seconds in the closing direction.

It is also possible that the abovementioned forces, i.e., the opening and/or closing forces, may be varied by ±approx. 1-2 N with respect to their amounts. In this case, it is preferable to proceed in such a way that the remaining values are then adjusted accordingly so that the corresponding force relations are maintained.

Furthermore, the present invention relates to a dispensing device having at least one hinge.

The dispensing device may include at least one door pivotally hinged to a body of the dispensing device by means of the hinge, such that the door can be opened in the first position of the hinge in a range from the closed state of the door to a first open position at a first opening angle and that the door in the second position of the hinge can be opened up to a second opening position, in particular to form a panic opening function, with a second opening angle which is greater than the first opening angle.

The first opening angle may be selected in a range between approx, 80° and approx, 110°, in particular in a range between approx. 85° and approx. 110°, This range is sufficient for the normal operation of the dispensing device and allows customers a convenient operation of the dispensing device.

In addition, the second opening angle may be selected in a range between approx. 105° and approx. 180°, in particular in a range between approx. 105° and approx. >160°. This range is sufficient to push the door further in a panic situation when the panic function is needed so that the supermarket aisle is sufficiently cleared to allow for an escape through the aisle.

BRIEF DESCRIPTION OF THE SEVERAL VIEWS OF THE DRAWING(S

Further details and advantages of the invention will now be explained in more detail with reference to an exemplary embodiment shown in the drawings.

The drawings show the following:

DETAILED DESCRIPTION OF THE INVENTION

Figure 1:
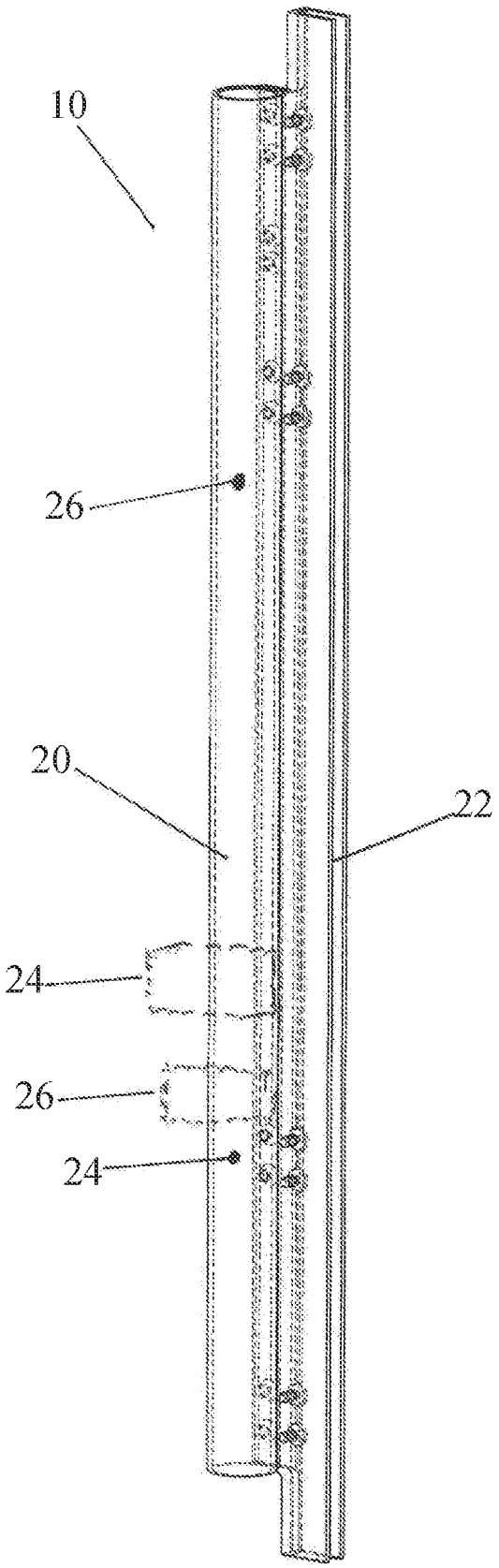
FIG. 1 is a perspective view of an embodiment of a hinge according to the invention.
Figure 2:
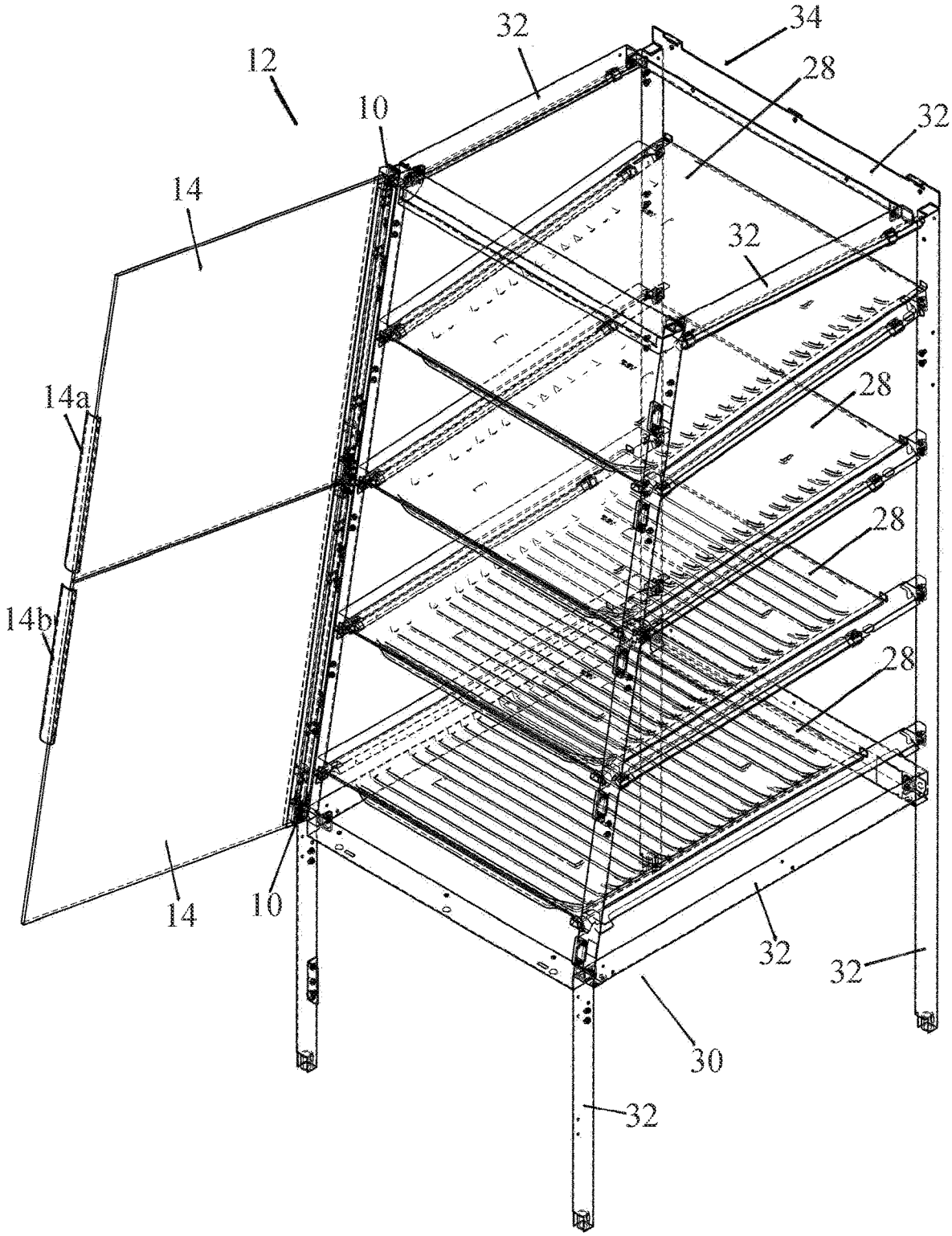
FIG. 2 shows a schematic plan view of a dispensing device with a hinge in the opened position of the door (opening angle approx. 90°)

FIG. 1 shows a perspective view of an embodiment of a hinge 10 according to the invention for a dispensing device 12 (see FIG. 2).

The hinge 10 is substantially bar-shaped and/or tubular for fastening to a door of the dispensing device 12 (see FIG. 2, here two doors 14, each with a hinge 10).

The hinge 10 has at least one main body 20 and an insertion rail 22 arranged on the main body 20 for the door 14.

In principle, it is conceivable that the insertion rail 22 is arranged rigidly on the main body 20. It is also conceivable that the insertion rail 22 is pivotally mounted on the main body 20.

The insertion rail 22 is U-shaped and may surround the door 14 on both sides.

At least one damping device 24 (indicated diagrammatically by box 24) and a panic hinge device 26 (indicated diagrammatically by box 26) is provided in the main body 20.

The damping device 24 may be a gas damper or an oil damper.

The panic hinge device 26 is also, for example, a gas damper or an oil damper, wherein the panic hinge device 26 is designed such that it does not engage in a first opening angle of the door 14 between 0° and 90° and only allows for a braked but wider opening of the door 14 from an opening angle of between approx. 90° and approx. 160°.

As can further be seen from FIGS. 1 and 2, the main body 20 and the insertion rail 22 have essentially the same length.

The insertion rail 22 projects slightly beyond the body of the main body 20 at both ends of the main body 20.

Thus, the insertion rail 22 extends substantially beyond the entire length of the main body 20.

As can further be seen from FIG. 2, the insertion rail 22 and the door 14 are of essentially the same length; that is to say, they have the identical length.

The door 14 shown in each case is a transparent door, in this case a glass door, on which the handle 14*a* or 14*b* is provided for gripping the door 14.

Figure 4:
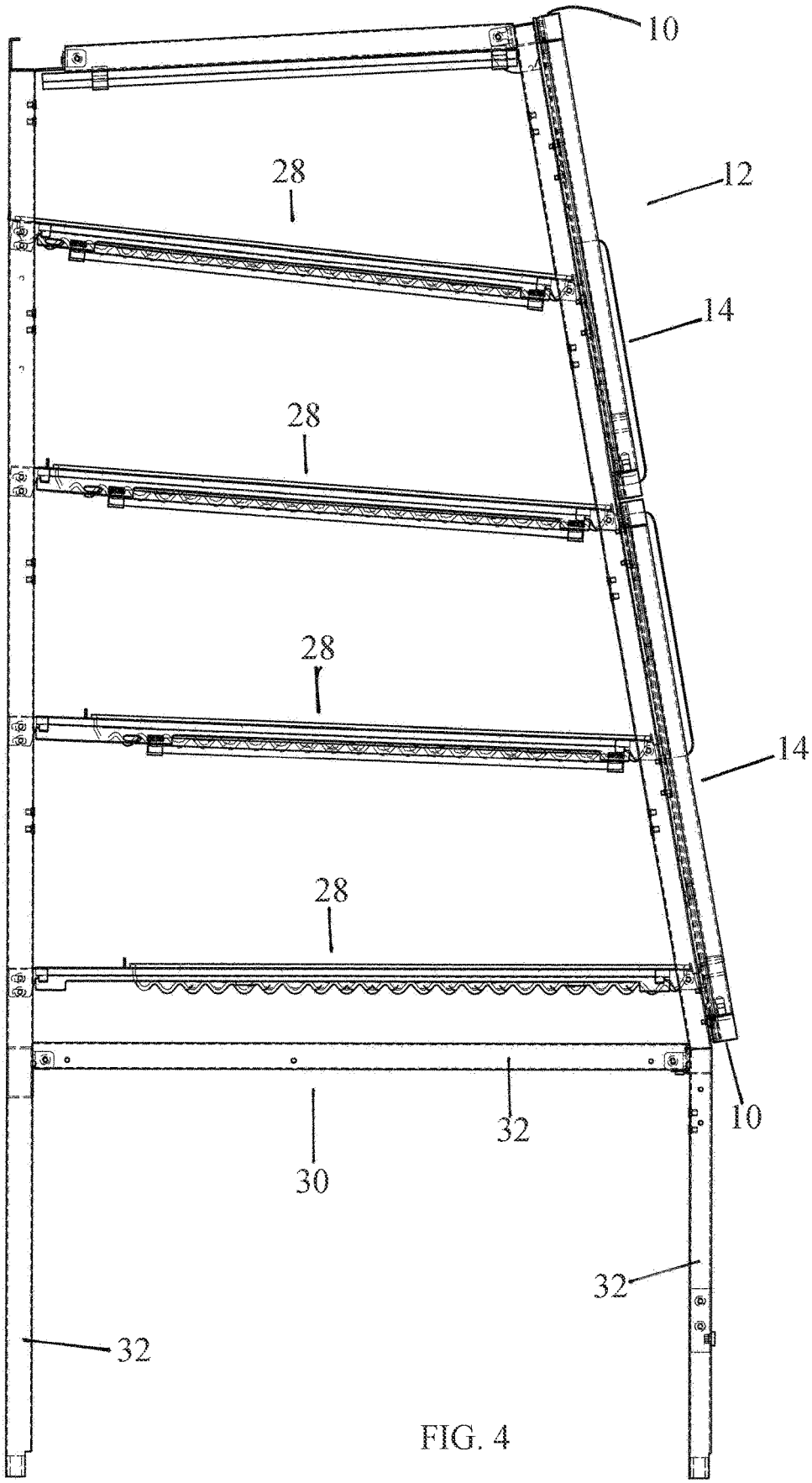
FIG. 4 shows a side view of the dispensing device with the door closed.

As can be seen in FIG. 2, the dispensing device 12 has a front area which can be closed or opened or closed with the door 14 in the closed state (see FIG. 4).

The front area itself comprises a falling slope of approx. 10° with respect to the vertical plane.

Inside the dispensing device 12, a plurality of slidable trays 28 is provided on which baked goods, for example, may be displayed and sold.

The dispensing device 12 comprises a main frame 30 formed of a plurality of bar-like struts 32 of different lengths.

The dispensing device 12 is hinged to a body 34 of the dispensing device 12 by means of the hinge 10, the body 34 being substantially defined by the main frame 30.

However, the main body 20 has substantially the identical diameter as the bar-like struts 32 so that the hinge 10 can be inserted into the main structure of the frame 30 without any problems and thus can also be perceived as one of the bar-like struts 32.

In FIG. 2, the door 14 is shown in the opened state at the end of a first pivoting range. The first pivoting range is defined so that it extends from the closed door 14 with an opening angle of 0° to an opening angle of approx. 90°.

In this first opening range, the hinge 10 provides a first pivoting resistance which is lower than the second pivoting resistance that occurs in the second pivoting range of the door 14 with an opening angle greater than 90°.

The second pivoting resistance is determined by the panic hinge device 26; therefore, only a damped and/or inhibited pivoting is made possible by the second pivoting resistance in the second pivoting range.

The function of the hinge 10 and its functional interaction with the dispensing device 12 will now be described as follows:

For dispensing unpackaged goods such as baked goods, the dispensing device 12 is typically positioned in spatially limited aisles of supermarkets.

In order to dispense the baked goods, the customer of a supermarket must open the door 14 pivotally arranged relative to the body 34 of the dispensing device 12.

Under normal operating conditions of the dispensing device 12, the door 14 can be opened only from the closed position of the door 14 to its first open position or to the end of the first pivoting range (see FIG. 2).

In this position, the door 14 has an opening angle of approx. 90°.

The closed position of the door 14 is shown in FIG. 4.

When the door 14 or doors 14 have assumed their first open position, they obstruct a significant portion of the aisle in which the dispensing device 12 is positioned.

If now, while the door 14 is in its first open position, a panic situation arises, the door 14, which significantly protrudes into the aisle of the supermarket, constitutes a considerable additional safety risk for the customers of the supermarket who are in the panic situation.

Figure 3:
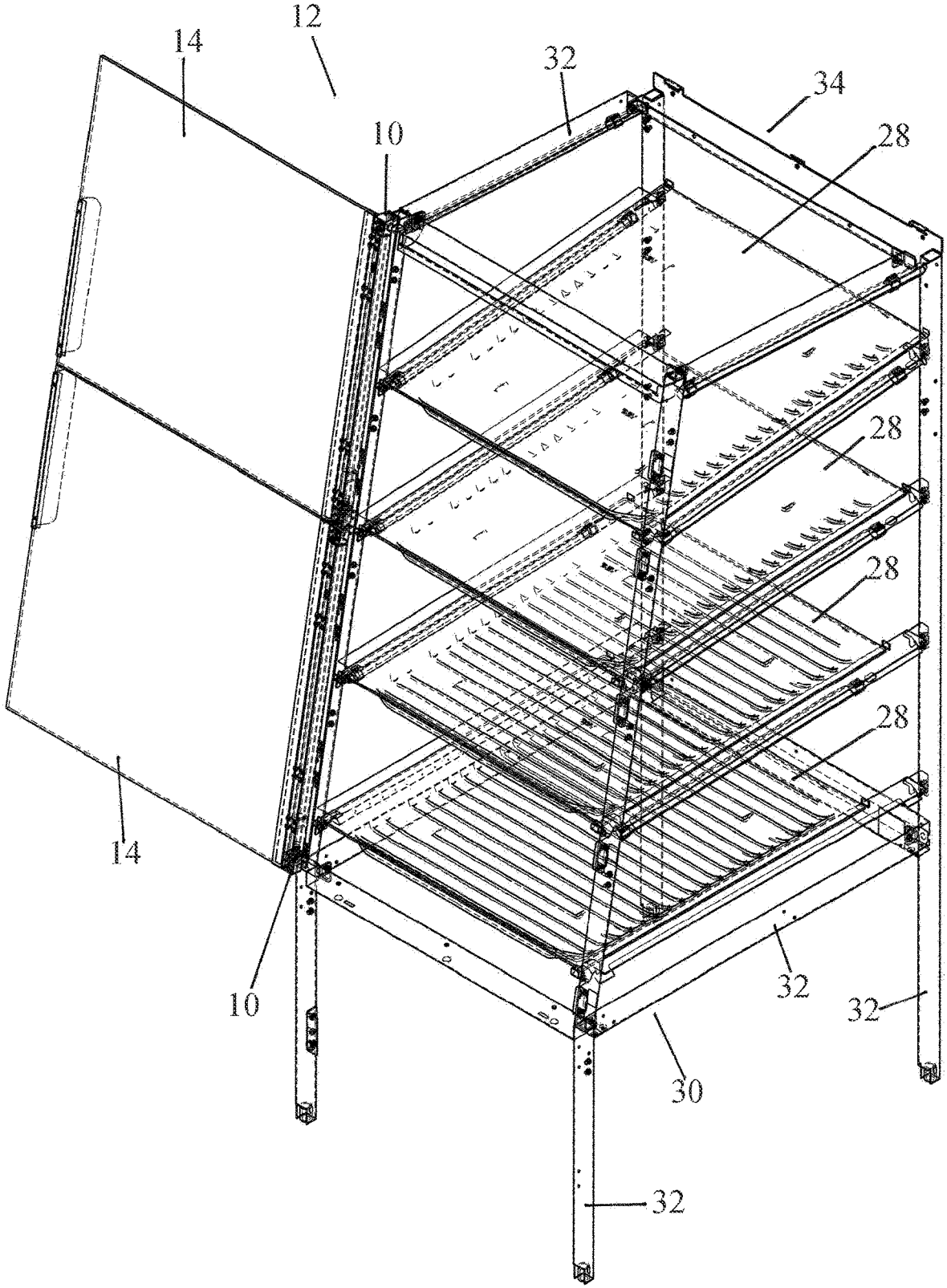
FIG. 3 shows a schematic perspective view of a dispensing device with the door in a further opened position (opening angle approx. 160° panic function)

In this case, the dispensing device 12 or the hinge 10 is designed to be transitioned to the second open position of the door 14, as shown in FIG. 3. This is particularly necessary if the customer should not succeed in the panic situation to properly return the door 14 to its regular closed position (see FIG. 4).

The hinge 10 is then transitioned from a first position to a second position during the transition from the first open position of the door 14 to its second open position, which is located at the end of the second pivoting range. In this case, the second pivoting resistance that is determined by the panic hinge device 26 must be overcome as well.

However, an opening of the door 14 or the doors 14 beyond the opening angle of 90° to a position with an opening angle of approx. 160°, as shown in FIG. 3, and even to approx. 180° is possible as described below.

Figure 5:
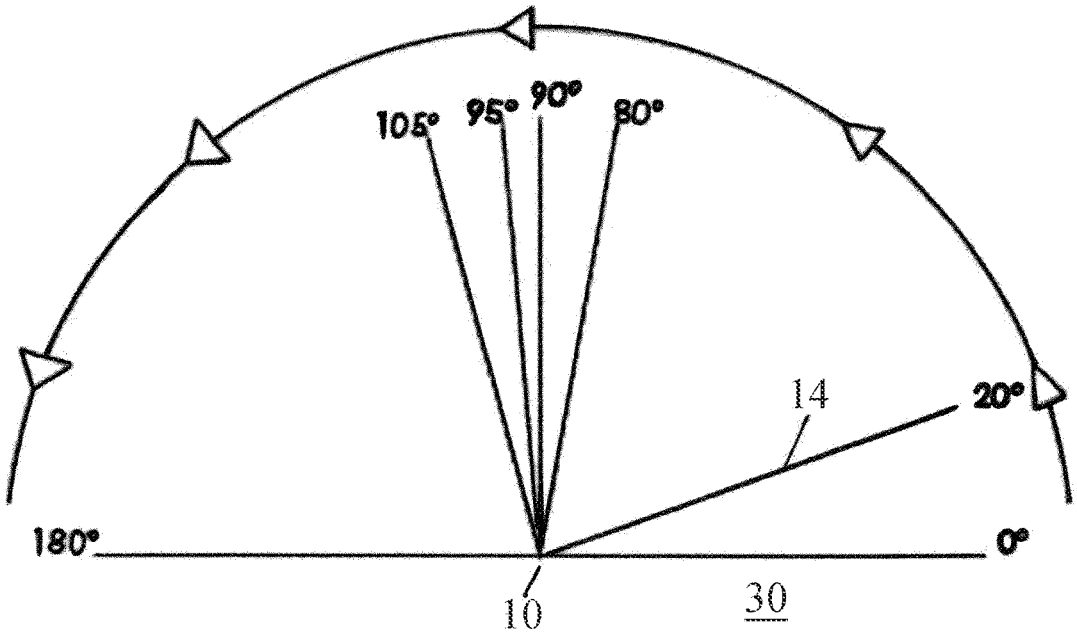
FIG. 5 shows a schematic opening movement of the door of the dispensing device.

In this context, the basic and schematic opening movement of the door 14 of the dispensing device 12 is also shown in FIG. 5.

As already explained above, the normal opening angle of the hinge 10 and of the door 14 is approx. 90°.

Within this angular range, the opening force relative to the outer edge of the door 14 should be approx. 5 N (approx. 5 Newtons).

The panic function should start from an opening angle of 85°-90° to approx. 105°-110°.

Within this angular range, the opening force should then be approx. 9-10 N (approx. 9-10 Newtons) relative to the outer edge of the door.

From an opening angle of approx. 105°-110° to approx. >160°, the hinge must continue to be openable in a damped manner in order to avoid damage to the door 14 or the hinge 10. The opening speed is irrelevant here.

Within this angular range, the opening force should then be approx. 8 N (approx. 8 Newtons) relative to the outer edge of the door.

An opening of 160° is sufficient because the door 14 finds a stop at the handlebar 14*a*, 14*b* of the adjacent door. Typically, a plurality of dispensing devices 12 are arranged next to each other. At the first dispensing device 12, which has only one dispensing device 12 next to it, a stop surface/area is provided on a side panel (not shown).

The opening time of the door 14 is a few seconds, preferably less than five seconds.

Figure 6:
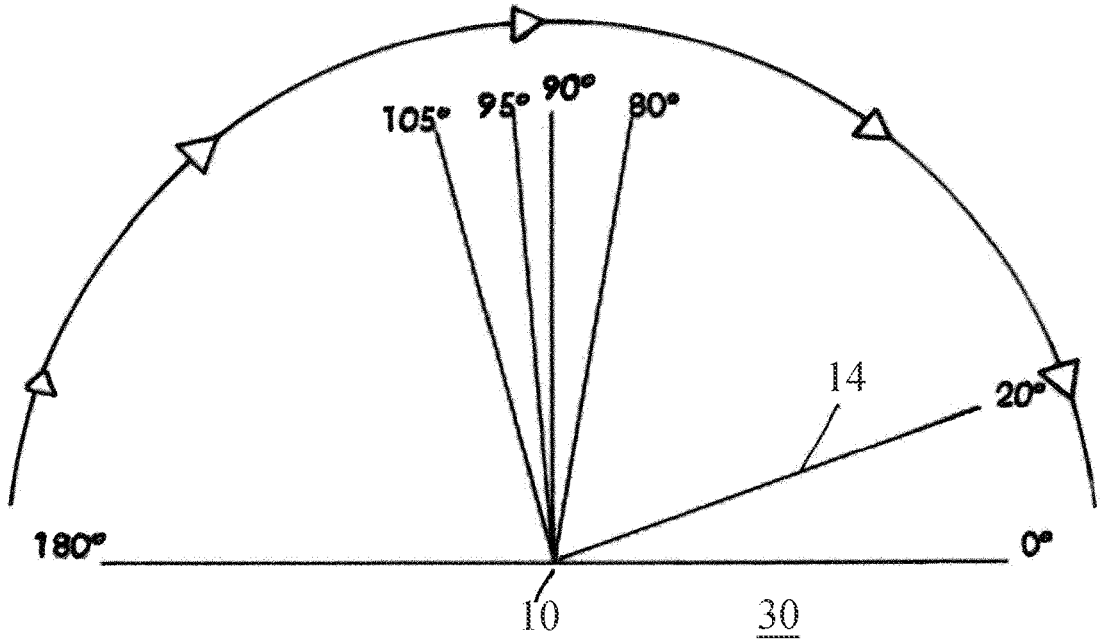
FIG. 6 shows a schematic closing movement of the door of the dispensing device.

Furthermore, FIG. 6 shows the schematic closing movement of the door 14 of the dispensing device 12 accordingly.

The hinge should be at least partially continuously damped at an opening angle from approx. 0° to approx. 90° in the closing direction and close automatically. The closing time lasts approx. 10 s in this angular range (approx. 10 seconds).

The closing force is gravity so that a self-closing but damped closing movement takes place (so-called damped hinge).

Below 20°, damping is not necessarily required and is not provided in the embodiment shown either.

Following an operation of the panic function (damped), the hinge 10 is manually swung back to the opening angle of approx. 90° in order to then ensure the normal or automatic and damped closing function, as already described above.

Within an angular range from approx. 180° to approx. 105°, the closing force should be approx. 8 N (approx. 8 Newtons) relative to the outer edge of the door.

Within an angular range between approx. 110° and 105° to approx. between 90° and 85° (within the angular range of the panic function), the closing force in the closing direction relative to the outer edge of the door should be approximately 9-10 N (approximately 9-10 Newtons).

FIG. 5 and FIG. 6 respectively show the opening movement of the door 14 in the counterclockwise direction and the closing movement of the door 14 in the clockwise direction. This representation is to be understood as purely exemplary.

In this context, it is also conceivable that the opening movement of the door 14 runs in the clockwise direction and the closing movement of the door 14 is correspondingly counterclockwise.

LIST OF REFERENCE SIGNS

10 Hinge
12 Dispensing device
14 Door
14*a* Handle
14*b* Handle
20 Main body
22 Insertion rail
24 Damping device
26 Panic hinge device
28 Slidable trays
30 Main frame
32 Struts
34 Body

SEQUENCE LISTING

Not Applicable

The invention claimed is:

1. A device (10) for holding a door (14) of a dispensing device (12), wherein the device (10) is substantially bar-shaped or tubular for fastening to the door (14) of the dispensing device (12), wherein the device (10) has at least one main body (20) and, arranged on the main body (20), an insertion rail (22) for the door (14), wherein the door (14) is inserted in the assembled state in the insertion rail (22) and held in the insertion rail (22), wherein at least one damping device (24) and at least one panic hinge device (26) are provided in the main body (20), wherein the device (10) comprises:

a first pivoting range having a first swiveling resistance and a second pivoting range having a second swiveling resistance, wherein the first swiveling resistance is lower than the second swiveling resistance, wherein the first swiveling resistance is determined by the damping device (24), wherein the second swiveling resistance is determined by the panic hinge device (26), and that, in the second pivoting range, only a damped or inhibited swiveling is made possible by the second swiveling resistance, wherein the second pivoting range has at least a first angular range and at least one second angular range adjoining the first angular range, wherein, at an initiation of a panic function according to which it is possible to open the already opened door (14) even more under increased effort, an opening force to be applied to the door (14) for opening the same even more is increased in the first angular range, and in the second angular range, the door (14) can be opened in a dampened manner with a lower opening force than in the first angular range.

2. The device (10) according to claim 1, characterized in that the main body (20) and the insertion rail (22) have substantially the same length.

3. The device (10) according to claim 2, characterized in that the insertion rail (22) extends substantially along the entire length of the main body (20).

4. The device (10) according to claim 1, characterized in that the insertion rail (22) and the door (14) have substantially the same length.

5. The device (10) according to claim 1, characterized in that the door (14) consists at least partially of a transparent material.

6. The device (10) according to claim 5, characterized in that the door (14) is a glass door or at least has a glass pane.

7. The device (10) according to claim 1, characterized in that the first pivoting range relates to an opening angle of the door (14) from the closed state of the door (14) up to an opening angle of the opened door (14) in a range from approx. 80° to approx. 110°.

8. The device (10) according to claim 7, characterized in that the second pivoting range relates to an opening angle of the door (14) and an opening angle of the open door (14) of wider than between approx. 85°-90° and approx. 160°-180°.

9. The device (10) according to claim 1, characterized in that the second pivoting range relates to an opening angle of the door (14) and an opening angle of the open door (14) of more than approx. 85°-90° to approx. 160°-180°.

10. The device (10) according to claim 1, characterized in that the insertion rail (22) is pivotably arranged on the main body (20) thereby making the device (10) a hinge.

11. The device (10) according to claim 1, characterized in that the first angular range extends across an opening angle of approx. 85°-90° to approx. 105°-110° or that the second angular range starts at approx. 105°-110°.

12. The device (10) according to claim 1, characterized in that the first pivoting range with its first pivoting resistance requires an opening force of approx. 5-8 N.

13. The device (10) according to claim 12, characterized in that the second pivoting range in the first angular range requires an opening force of approx. 9-12 N.

14. The device (10) according to claim 13, characterized in that the second pivoting range in the second angular range requires an opening force of approx. 8 N.

15. The device (10) according to claim 1, characterized in that the second pivoting range in the first angular range requires an opening force of approx. 9-12 N.

16. The device (10) according to claim 15, characterized in that the second pivoting range in the second angular range requires an opening force of approx. 8 N.

17. The device (10) according to claim 1, characterized in that the second pivoting range in the second angular range requires an opening force of approx. 8 N.

18. A dispensing device (12) having at least one device (10) according to claim 1.

19. The dispensing device (12) according to claim 18, characterized in that the dispensing device (12) has at least one door (14) which is pivotably moved by means of the device (10) on a body (34) of the dispensing device (12) such that the door (14) in the first position of the device (10) can be opened in a range from the closed state of the door (14) to a first open position with a first opening angle and that the door (14) in the second position of the device (10), for the provision of a panic opening function, can be opened to a second open position with a second opening angle which is greater than the first opening angle.

20. The dispensing device (12) according to claim 19, characterized in that the first opening angle is selected in a range between approx. 80° and approx. 110°.

21. The dispensing device (12) according to claim 20, characterized in that the second opening angle is selected in a range between approx. 105° and approx. 180°, in particular in a range between approx. 105° and approx. greater than 160°.

22. The dispensing device (12) according to claim 19, characterized in that the second opening angle is selected in a range between approx. 105° and approx. 180°.

* * * * *